US006817309B2

(12) United States Patent
Horton

(10) Patent No.: US 6,817,309 B2
(45) Date of Patent: Nov. 16, 2004

(54) CELLULAR SPAR APPARATUS AND METHOD

(75) Inventor: Edward E Horton, Houston, TX (US)

(73) Assignee: Deepwater Technologies, Inc., Houston, TX (US)

( * ) Notice: Subject to any disclaimer, the term of this patent is extended or adjusted under 35 U.S.C. 154(b) by 0 days.

(21) Appl. No.: 10/353,416

(22) Filed: Jan. 29, 2003

(65) Prior Publication Data

US 2003/0221603 A1 Dec. 4, 2003

Related U.S. Application Data

(63) Continuation-in-part of application No. 10/059,757, filed on Jan. 29, 2002, now abandoned.

(51) Int. Cl.[7] ..... B63B 35/44
(52) U.S. Cl. ..... 114/264; 114/265
(58) Field of Search ..... 114/265, 264; 405/195.1

(56) References Cited

U.S. PATENT DOCUMENTS

| | | | | |
|---|---|---|---|---|
| 2,553,371 A | | 5/1951 | Huppert | |
| 3,360,810 A | | 1/1968 | Busking | |
| 3,510,892 A | | 5/1970 | Monnereau et al. | |
| 3,952,684 A | * | 4/1976 | Ferguson et al. | 114/230.2 |
| 4,234,270 A | * | 11/1980 | Gjerde et al. | 405/202 |
| 4,241,685 A | | 12/1980 | Mougin | |
| 4,470,723 A | | 9/1984 | Michel et al. | |
| 4,630,968 A | | 12/1986 | Berthet et al. | |
| 4,702,321 A | | 10/1987 | Horton | |
| 4,722,367 A | | 2/1988 | Swink et al. | |
| 4,740,109 A | | 4/1988 | Horton | |
| 4,766,836 A | * | 8/1988 | Behar et al. | 114/256 |
| 5,197,826 A | | 3/1993 | Korloo | |
| 5,443,330 A | | 8/1995 | Copple | |
| 6,206,614 B1 | | 3/2001 | Blevins et al. | |
| 6,213,045 B1 | | 4/2001 | Gaber | |
| 6,349,664 B1 | * | 2/2002 | Brown et al. | 114/264 |
| 6,575,665 B2 | | 6/2003 | Richter et al. | |
| 2001/0036387 A1 | | 11/2001 | Richter et al. | |

FOREIGN PATENT DOCUMENTS

| | | |
|---|---|---|
| FR | 2 553 371 | 4/1985 |
| WO | 95/28316 | 10/1995 |
| WO | 99/10230 | 4/1999 |

OTHER PUBLICATIONS

MPU "Semi Floating Production Unit, MPU Enterprise,", p. 1–7.

"Steel hybrid riser extends flexiblity in ultra–deepwater operations", by S. Courpie et al., Offshore, May 2001.

* cited by examiner

*Primary Examiner*—Ed Swinehart
(74) *Attorney, Agent, or Firm*—Klein, O'Neill & Singh, LLP; Howard J. Klein

(57) ABSTRACT

A floating hull for a spar-type offshore oil and gas drilling and production platform comprises a plurality of parallel tubular cells that are subdivided into compartments having a buoyancy controlled by one or both of fixed and variable ballast. The cells may be fabricated in a variety of ways and shapes and include side wall openings for admitting and discharging seawater and petroleum ballast with pumps. Fixed and/or variable ballast may be disposed on or in the cells to adjust buoyancy, trim, and stability. Lower and upper portions of the cells may extend above or below the others for trim or stability. Longitudinal recesses may be formed in an exterior peripheral surface for routing of mooring lines and piping. Stepped helical strakes can be disposed on an outer peripheral surface of the platform or some of the cells to reduce vortex-induced vibrations of the platform. Methods are described for efficient construction of the floating hull in water.

30 Claims, 15 Drawing Sheets

CELLULAR SPAR APPARATUS AND METHOD

CROSS-REFERENCE TO RELATED APPLICATIONS

This Application is a continuation-in-part of U.S. patent application Ser. No. 10/059,757, filed Jan. 29, 2002, now abandoned the disclosure of which is incorporated herein by this reference.

STATEMENT REGARDING FEDERALLY SPONSORED RESEARCH OR DEVELOPMENT (Not Applicable)

REFERENCE TO APPENDIX (Not Applicable)

BACKGROUND OF THE INVENTION

1. Field of the Invention

This invention relates to floating offshore oil and gas drilling and production equipment in general, and in particular, to a floating cellular hull for a spar-type, deep water, offshore oil and gas drilling and production platform.

2. Description of Related Art

Offshore oil and gas drilling and production operations involve the provision of a vessel, or platform, sometimes called a "rig," on which the drilling, production and storage equipment, together with the living quarters of the personnel manning the platform, if any, are mounted. In general, offshore platforms fall into one of two groups, viz., "fixed" and "floating" platforms.

Fixed platforms comprise an equipment deck supported by legs that are seated directly or indirectly on the sea floor. While relatively stable, they are typically limited to relatively shallow waters, i.e., depths of about 500 feet (150 m), although one so-called "compliant piled tower" ("CPT") platform built for the Amerada Hess Corporation, called the "Baldpate" tower, is said to be operating at a depth of 1648 ft. (500 m).

Floating platforms are typically employed in water depths of 500 ft. and deeper, and are held in position over the well site by mooring lines anchored to the seabed, or motorized thrusters located on the side of the platform, or both. Although floating platforms are more complex to operate because of their greater movement in response to wind and water conditions, they are capable of operating at substantially greater depths than fixed platforms, and are also more mobile, and hence, easier to move to other well sites. There are several different types of floating platforms, including so-called "drill ships," tension-leg platforms ("TLPs"), semi-submersibles, and "spar" platforms.

Spar platforms comprise long, slender, buoyant hulls that give them the appearance of a column or spar when floating in their upright operating position, in which an upper portion extends above the waterline and a lower portion is submerged below it. Because of their relatively slender, elongated shape, they present a much smaller area of resistance to wind and wave forces than do other types of floating platforms, and accordingly, have been a relatively successful design over the years. Examples of spar-type floating platforms used for oil and gas exploration, drilling, production, storage, and gas flaring operations may be found in the patent literature in, e.g., U.S. Pat. No. 6,213,045 to S. Gaber; U.S. Pat. No. 5,443,330 to R. Copple; U.S. Pat. Nos. 5,197,826; 4,740,109 to E. Horton; U.S. Pat. No. 4,702,321 to E. Horton; U.S. Pat. No. 4,630,968 to H. Berthet et al.; U.S. Pat. 4,234,270 to T. Gjerde, et al.; U.S. Pat. No. 3,510,892 to G. Monnereau et al.; and U.S. Pat. No. 3,360,810 to B. Busking.

Despite their relative success, spar-type platforms include some aspects that require improvement. For example, because of their elongated, slender shape, they can be relatively more complex to manage during operation than other types of platforms in terms of control over their storage capability, buoyancy, trim, and stability.

Other difficulties relate to their manufacturability. Current manufacturing techniques involve fabricating short cylindrical segments of the hull, stacking the segments successively in a building berth, and joining successive segments to the stack until the full height of the structure is reached. The upright hull structure is then tilted down and skidded onto a barge or a heavy lift vessel for transportation to the well site, where the equipment deck is attached. This construction method has a number of drawbacks. For example, the large diameter cylindrical segments require close alignment to ensure good welds at the segment joints. Accordingly, a substantial number of the segments may be misaligned with each other. Further, a substantial portion of the assembly must be performed at relatively large heights above the ground. Additionally, the assembly berth must be capable of supporting the entire weight of the hull within a relatively small area, and the finished structure must be tilted down before transport.

In light of the foregoing problems, a long-felt, yet unsatisfied need exists in the industry for a floating hull for a spar-type offshore platform that affords a substantially greater flexibility in, and control over, the vessel's storage capability, buoyancy, trim, and stability, as well as for simpler, more reliable, and less costly methods of making it.

BRIEF SUMMARY OF THE INVENTION

In accordance with one aspect of the present invention, a floating hull of a spar-type platform is provided for supporting an equipment deck used in deepwater offshore oil and gas drilling and production operations that affords a substantially greater flexibility in, and control over, the vessel's storage capability, buoyancy, trim, stability, and hence, safety, than the floating platforms of the prior art. This is achieved in substantial part by incorporating a plurality of elongated, parallel tubular cells into the hull, positioning some of the cells higher or lower in the water than the other cells, and subdividing the cells into compartments whose buoyancy and trim can be selectably adjusted by the use of fixed or variable ballast, or a combination thereof, e.g., a solid ballast supported in or on the exterior of the cells, and/or a liquid ballast, e.g., petroleum or seawater, selectably pumped into or out of selected ones of the cells or compartments thereof, or a combination of the foregoing types of ballasts.

In one exemplary embodiment, the novel floating hull comprises a tubular central cell that may define a center well, and at least one tubular secondary cell disposed parallel and connected to the central cell with an elongated web. In a variant thereof, the central cell may be connected to the secondary cell by a second elongated web to form a third tubular "interstitial" cell parallel and adjacent to the central and secondary cells. In yet another possible variant, a second tubular secondary cell may be connected to the central cell by a second elongated web, and a third elongated web can connect the first secondary cell to the second secondary cell, thereby forming a third tubular interstitial cell parallel and adjacent to the central and secondary cells. In this manner, a floating hull can be constructed containing a large number of such parallel tubular cells, each having a wide variety of possible cross-sectional shapes, e.g., circular, polygonal, or egg-shaped.

In another exemplary embodiment, the cells of the hull may be formed of a plurality of elongated wall segments, some of which comprise recurvate elements, each having a first end joined to a side wall of the central cell or a first adjacent secondary cell, and an opposite second end joined to the side wall of a second adjacent secondary cell. Alternatively, the elongated wall segments of the cells may comprise webbed elements, each comprising at least one elongated web and at least one elongated flange disposed perpendicular to the web, in the manner of an I-beam. These webbed elements may have cross sections that are T-shaped, I-shaped or II-shaped. The walls of the cells may comprise a metal, e.g., plate steel, reinforced concrete, or a composite material that includes a resin and a reinforcing fiber, e.g., fiberglass.

In another exemplary embodiment, a lower portion of one or more of the cells may extend below the other cells when the hull is floating upright in water, and ballast, either fixed or variable, e.g., a solid ballast or sea water, or both, can be disposed on or in the extended lower portion. The fixed ballast serves to lower the center of gravity of the platform substantially below its center of buoyancy, thereby enhancing the stability of the platform by increasing its natural period above that of the waves in, e.g., a storm condition, and the variable ballast can be used to correct trim and compensate for variations in the load weight of the platform.

In another exemplary embodiment, an upper end of one or more of the cells of the hull can be disposed below the upper ends of the other cells when the hull is floating upright in water, and further, can be positioned to lie either above or below the surface of the water, for trim and stability purposes. Thus, when the upper ends of these cells are positioned below the surface of the water, the hull's water plane area is decreased, thereby increasing its natural period, whereas, when they are positioned above the surface of the water but below the deck, they minimize wave loads on the hull.

In another exemplary embodiment, one or more longitudinal recesses may be formed in an exterior peripheral surface of the platform, e.g., at the juncture of two cells, and mooring lines and piping may be routed in the recesses to reduce drag on the platform and undesirable, vortex-induced vibrations.

In another exemplary embodiment, a side wall of one or more of the cells includes one or more openings for admitting seawater into and discharging it from the cell or the buoyant compartment contained therein. The buoyant compartments, can comprise one or more horizontal bulkheads disposed within the cells. A pump may be connected to the buoyant compartments and operative to selectably pump air or water into or out of selected ones of the compartments.

In yet another exemplary embodiment, helical strakes can be disposed on an outer peripheral surface of all or some of the cells of the hull to reduce vortex-induced vibrations resulting from currents acting on the platform.

In another aspect of the invention, methods are provided for the efficient construction of the floating hull of the invention. In one exemplary embodiment, the method comprises providing a central tubular cell and a secondary tubular cell disposed parallel to the central cell, and connecting the central cell to the secondary cell with an elongated web, e.g., by a welding or chemical bonding process. Additionally, the central cell may be connected to the secondary cell with a second elongated web such that a third tubular cell is formed parallel and adjacent to the central and secondary cells. Alternatively, a third tubular cell may be provided and arranged parallel to the first and second cells, and then connected to each of the central and secondary cells with respective second and third elongated webs, such that a fourth tubular interstitial cell is formed parallel and adjacent to the central and secondary cells. Using this technique, a cellular floating hull can be built-up quickly and efficiently.

In other exemplary embodiments of the method, the top and bottom ends of the central cell can be closed off, e.g., with bulkheads, thereby rendering it buoyant, and then floating the central cell in a body of water, such as at a graving dock or shipyard, such that a long axis of the cell is disposed horizontally, and the weight of the cell is at least partially borne by the water. This embodiment enables the central cell to be rotated easily in the water about its long axis, e.g., with cranes, before successively connecting one or more secondary cells to it.

A better understanding of the above and many other features and advantages of the present invention may be obtained from a consideration of the detailed description thereof below, particularly if such consideration is made in conjunction with the figures of the appended drawings.

DETAILED DESCRIPTION OF THE INVENTION

Figure 19:
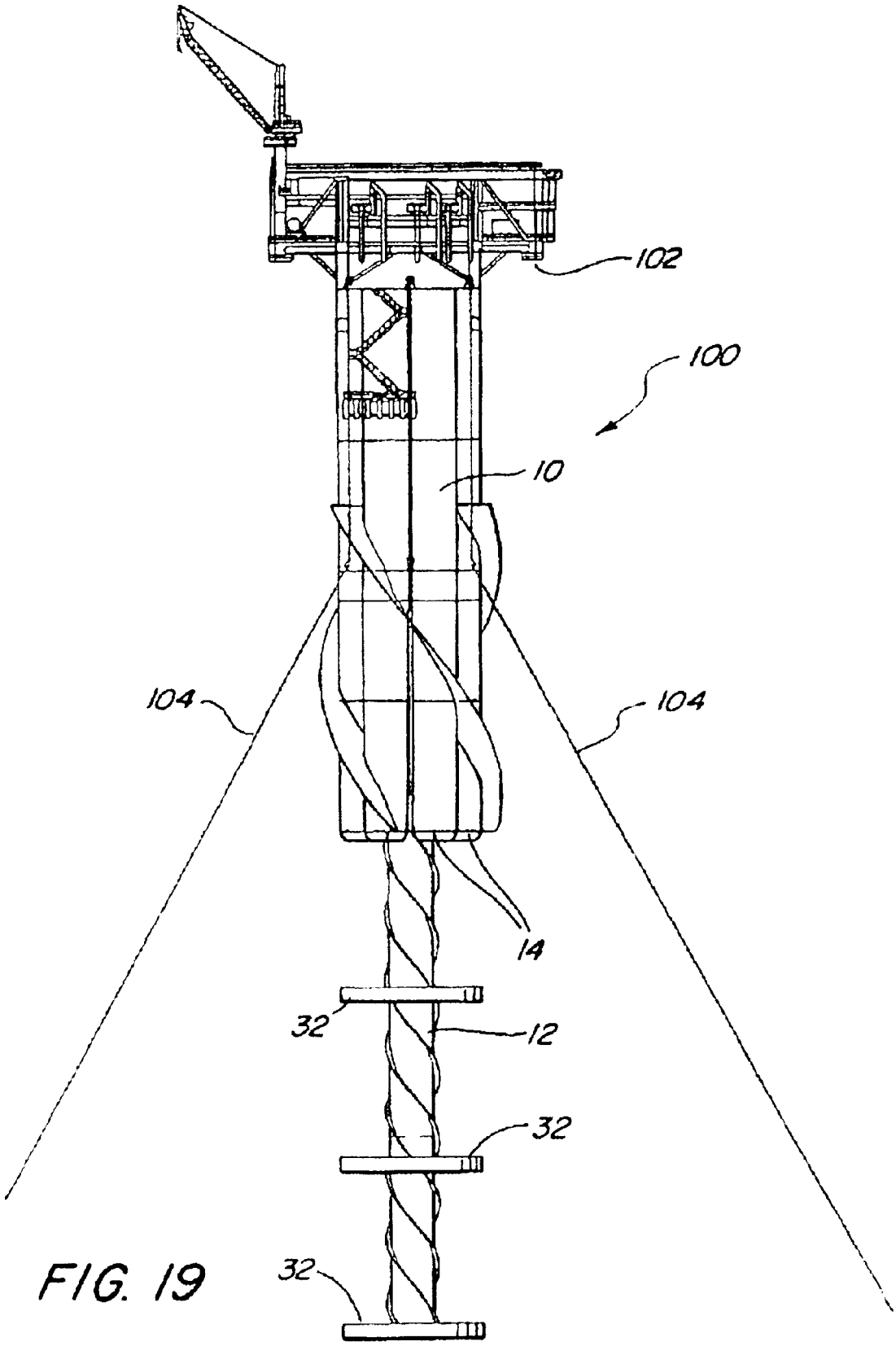
FIG. 19 is an elevation view of a spar-type platform incorporating an equipment deck supported by a floating hull in accordance with the present invention, shown floating in a deep body of water and tethered to the seabed by a plurality of mooring lines.
Figure 20:
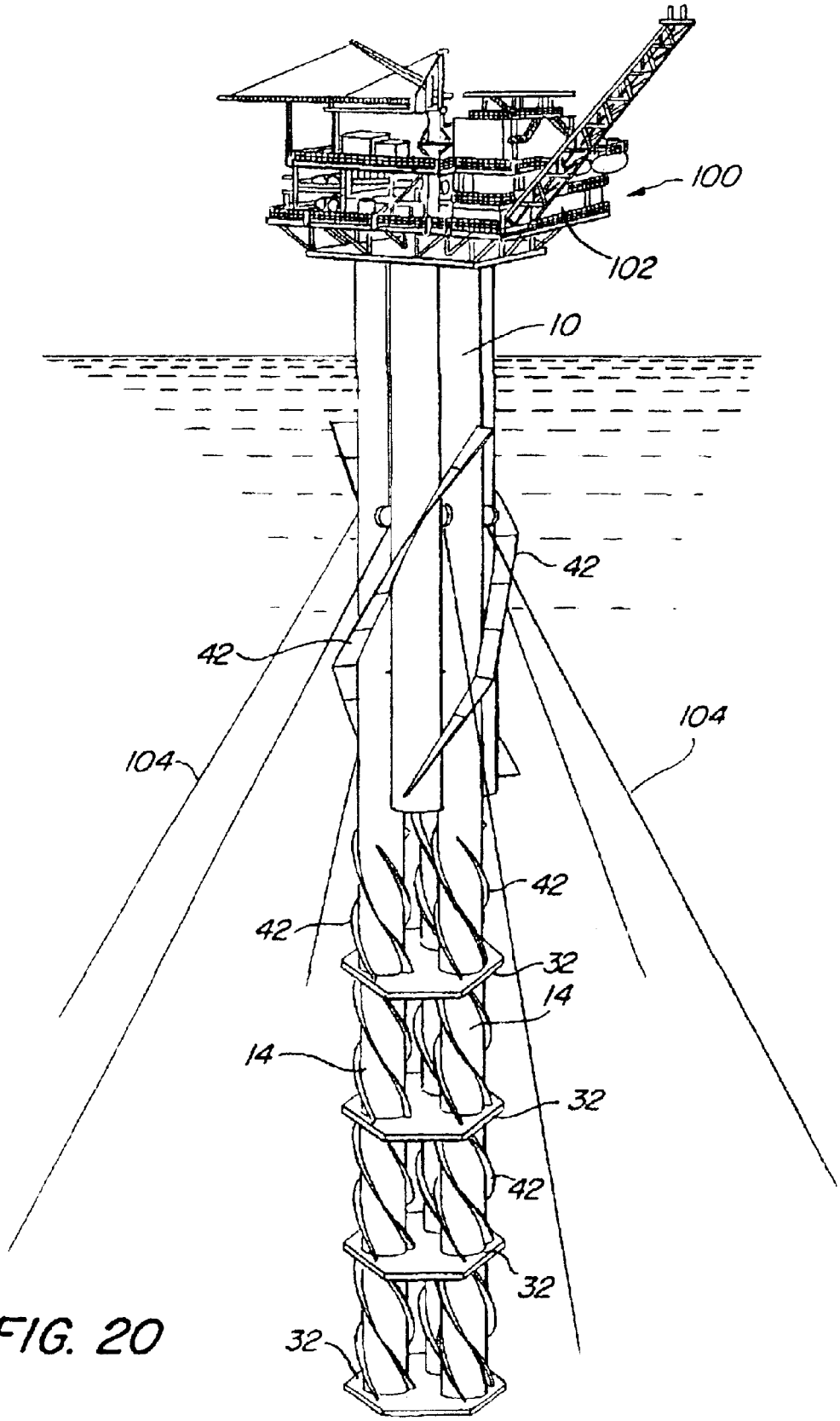
FIG. 20 is top-and-side perspective view of another platform similar to that of FIG. 19 and incorporating another embodiment of a cellular floating hull in accordance with the present invention.

Two exemplary cellular floating hulls 10 in accordance with the present invention are respectively illustrated in the elevation and top-and-side perspective views of FIG. 19 and 20, wherein the respective hulls are each shown supporting an equipment deck 102 of a spar-type, deep water, offshore oil and gas drilling and production platform 100 floating upright in a deep body of water and anchored to the seabed by a plurality of mooring lines 104.

Figure 1:
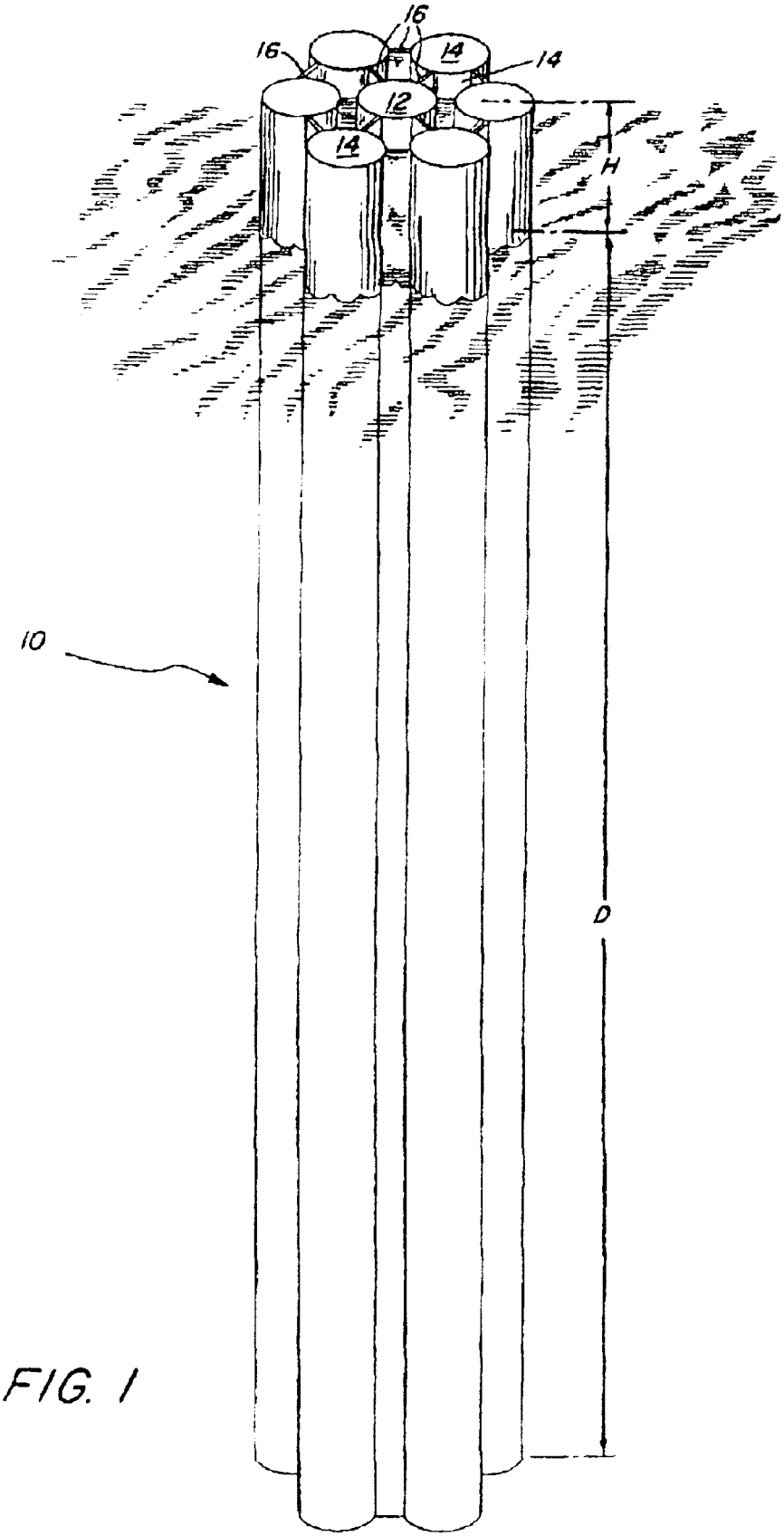
FIG. 1 is top-and-side perspective view of an exemplary embodiment of a floating hull in accordance with the present invention, shown floating upright in a body of water.
Figure 2:
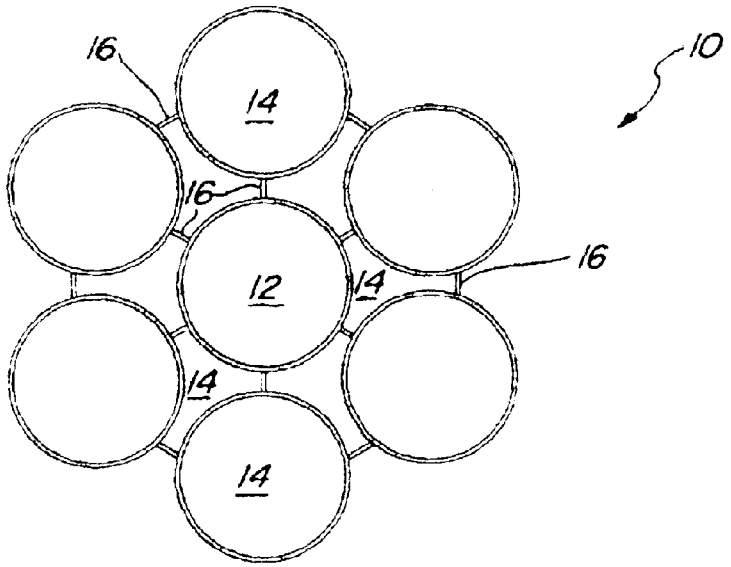
FIG. 2 is a top plan view of the hull shown in FIG. 1.
Figure 3:
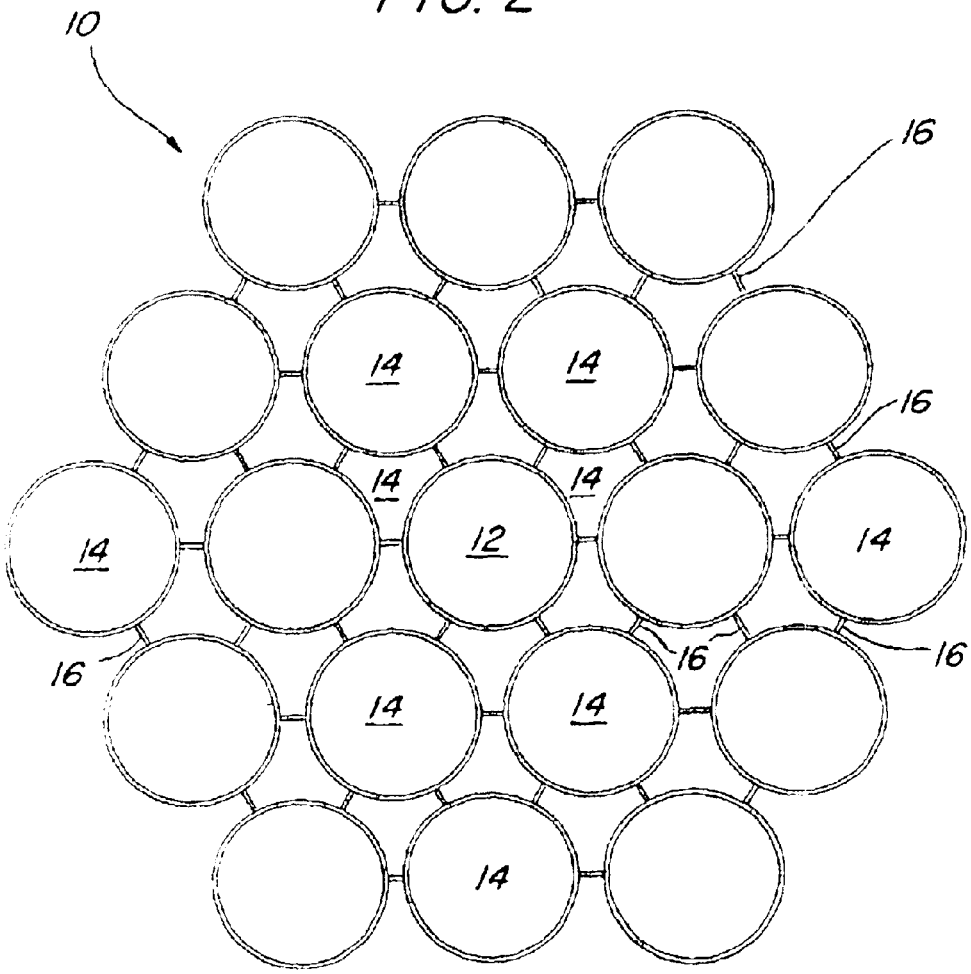
FIG. 3 is a top plan view of another exemplary embodiment of a floating hull in accordance with the present invention.

Another exemplary floating hull 10 in accordance with the present invention is illustrated in more detail in the top-and-side perspective and top plan views of FIGS. 1 and 2, in which the equipment deck 102 and other elements of the platform 100 have been omitted for clarity, and in which the hull is shown floating in the upright, operating position. The exemplary hull comprises a lower portion submerged below the surface of the water to a depth D, which in one embodiment, may as deep as 500 ft. (152 m), and an upper portion extending above the surface of the water to a height H, which may be as high as 50 ft. (15 m). The particular exemplary hull illustrated may have cell diameters ranging from 25-50 ft. (7.6-15.2 m), weigh between 8,000 and 18,000 tons (7144-16,074 MT), and be capable of storing 275,000-1,100,000 barrels of oil.

Figure 4:
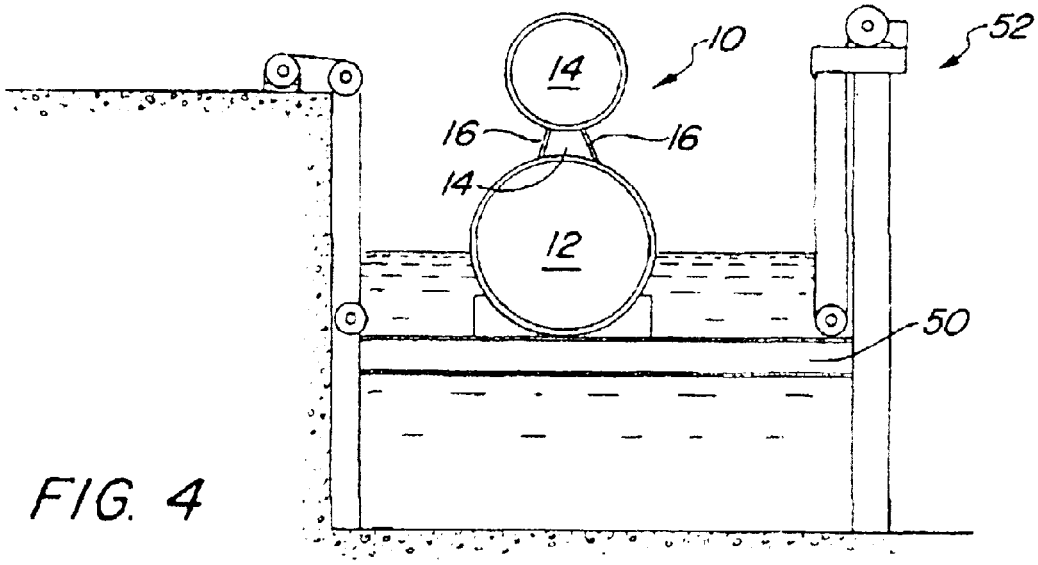
FIG. 4 is an elevation view of an end of a tubular central cell of a hull disposed horizontally on the elevator of a dry dock such that its weight is borne by both the water and the elevator, and with a single tubular secondary cell connected to it with a pair of webs to form a third, interstitial, tubular cell therebetween.
Figure 5:
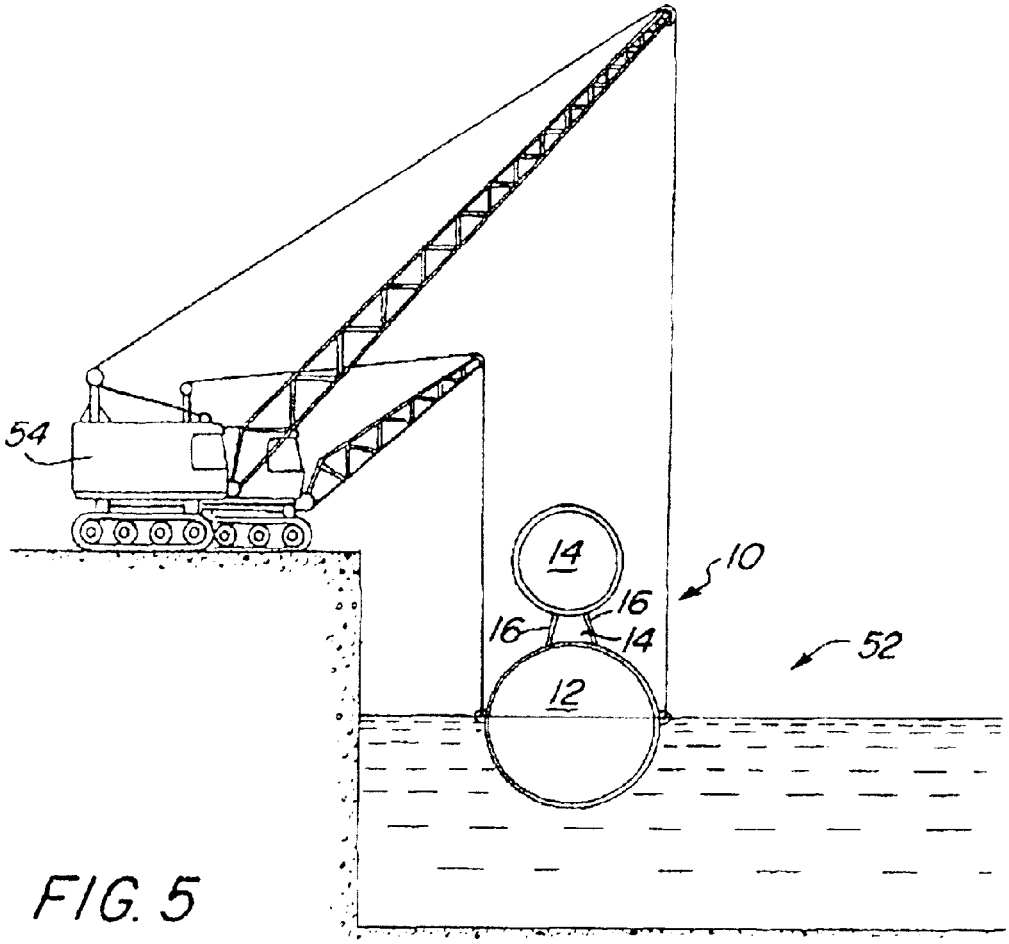
FIGS. 5–11 are successive elevation views similar to that of FIG. 4, except that the central cell is shown floating horizontally in a shallow body of water, and a pair of cranes is being used to support and rotate the central cell in the water about its long axis so that additional tubular secondary cells can be connected to it successively.
Figure 6:
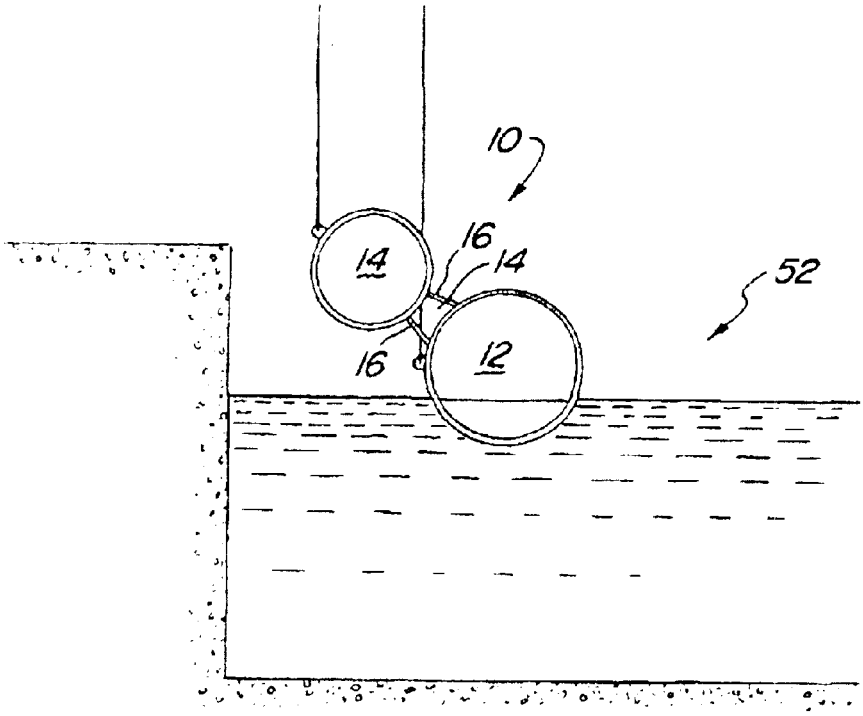
Figure 7:
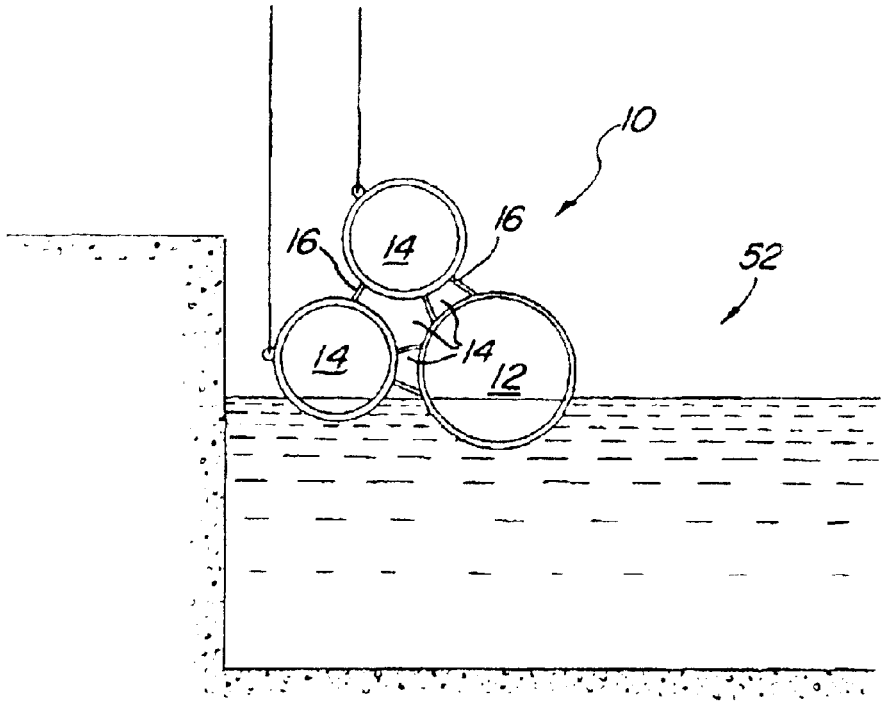
Figure 8:
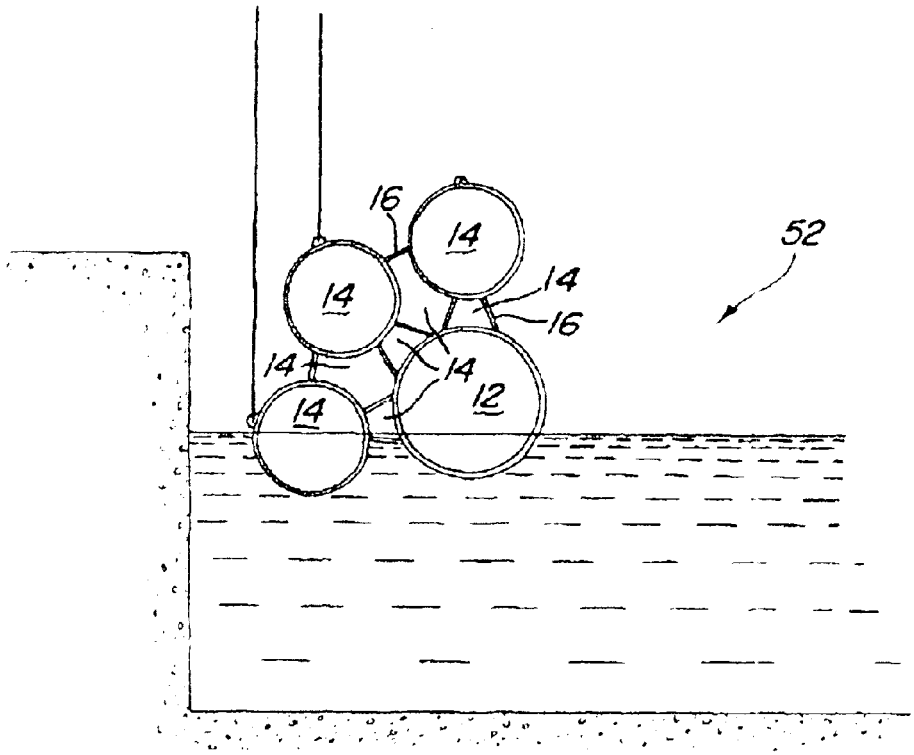
Figure 9:
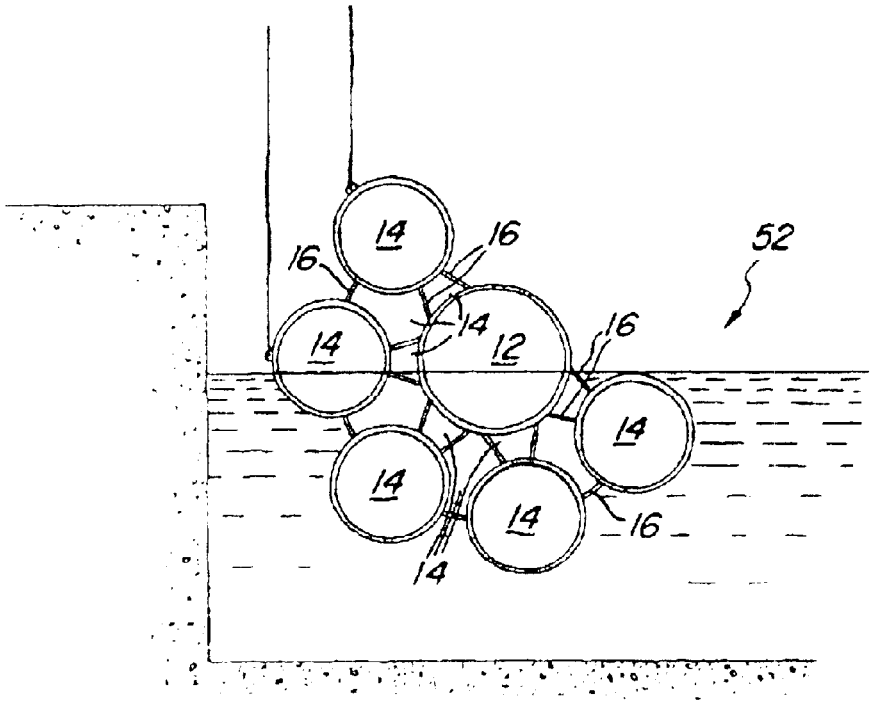
Figure 10:
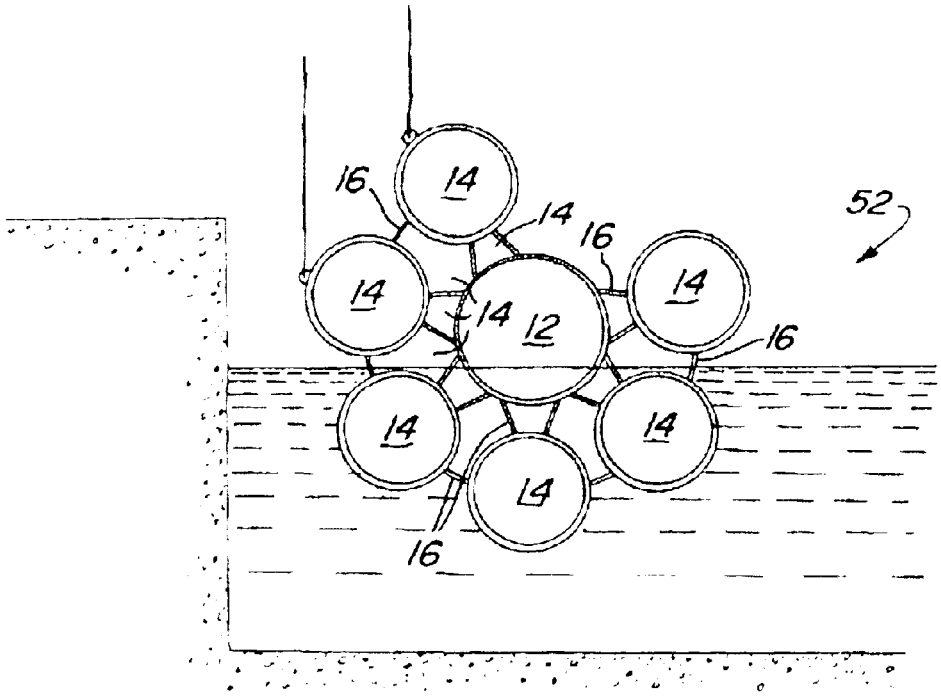
Figure 11:
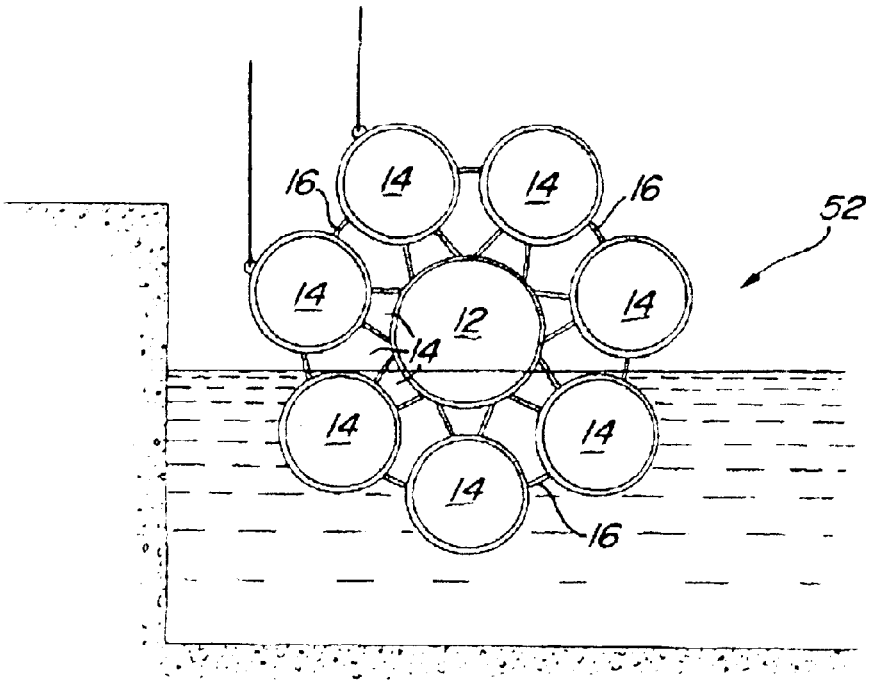

The exemplary hull 10 illustrated in FIGS. 1 and 2 comprises a tubular central cell 12 that can define a "center well," at least one tubular secondary cell 14 disposed parallel to the central cell, and at least one elongated web 16 connecting the central cell to the secondary cell. In a variant thereof, the hull may comprise a second tubular secondary cell, a second elongated web connecting the central cell to the second secondary cell, and a third elongated web connecting the first secondary cell to the second secondary cell and forming an "interstitial" secondary cell 14 parallel and adjacent to the central and secondary cells, as illustrated in FIGS. 1 and 2. In yet another possible variant thereof, the hull may include a second elongated web 16 connecting the central cell to the secondary cell and forming an interstitial secondary cell parallel and adjacent to the central and first secondary cells, as described below and illustrated in the end view of the horizontally disposed hull of FIG. 4.

Figure 12:
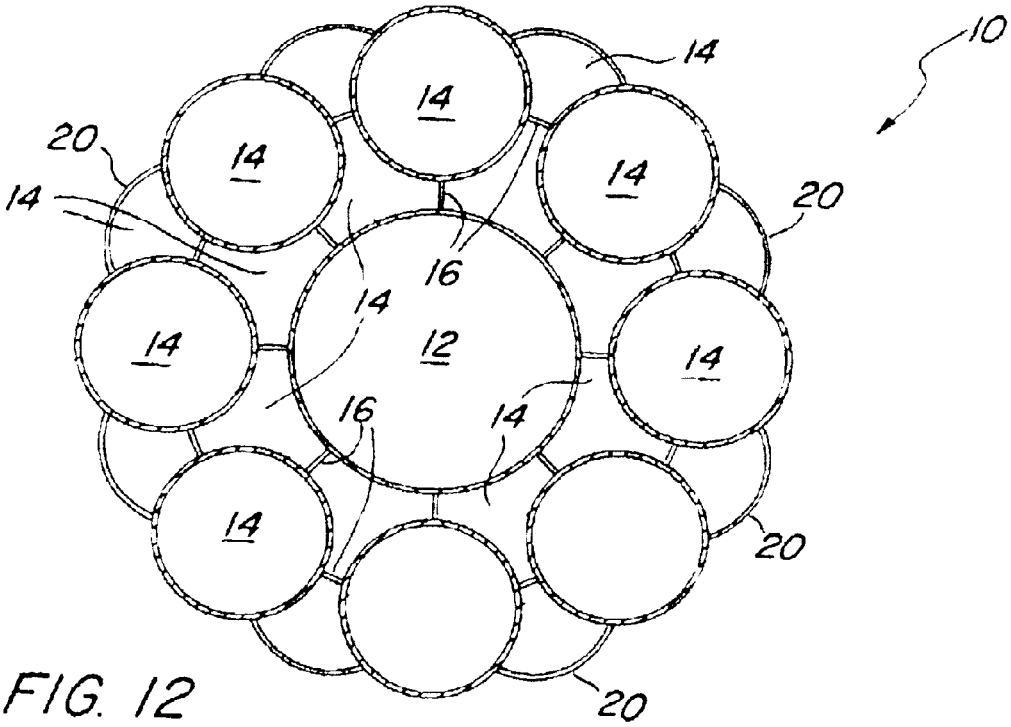
FIGS. 12–15 are respective top plan views of four other exemplary embodiments of floating hulls in accordance with the present invention.
Figure 13:
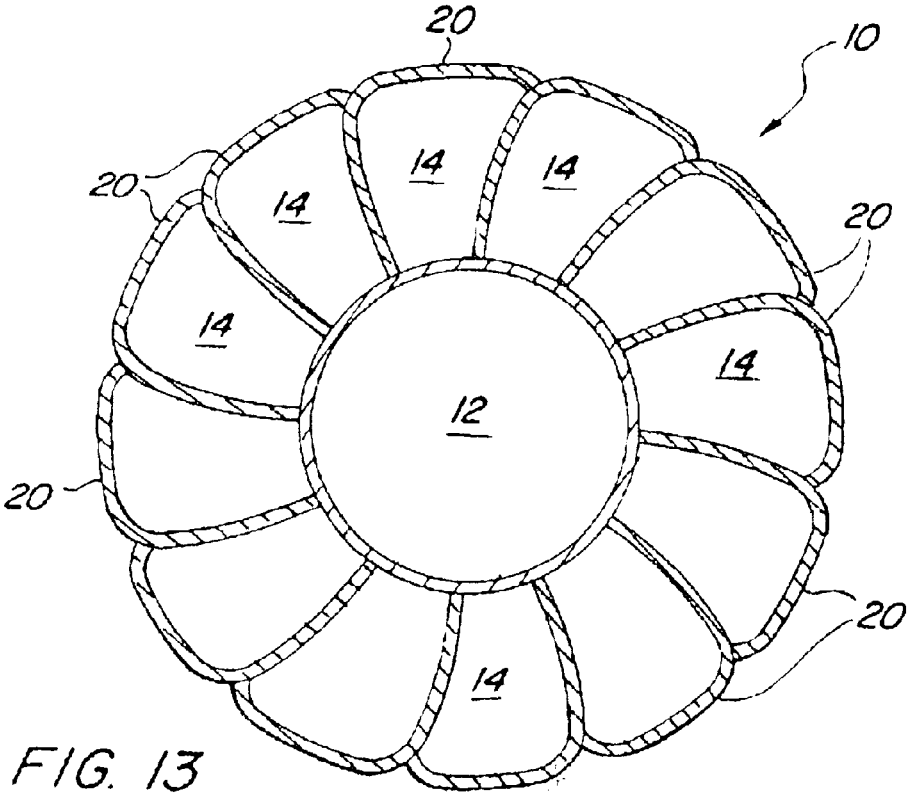
Figure 14:
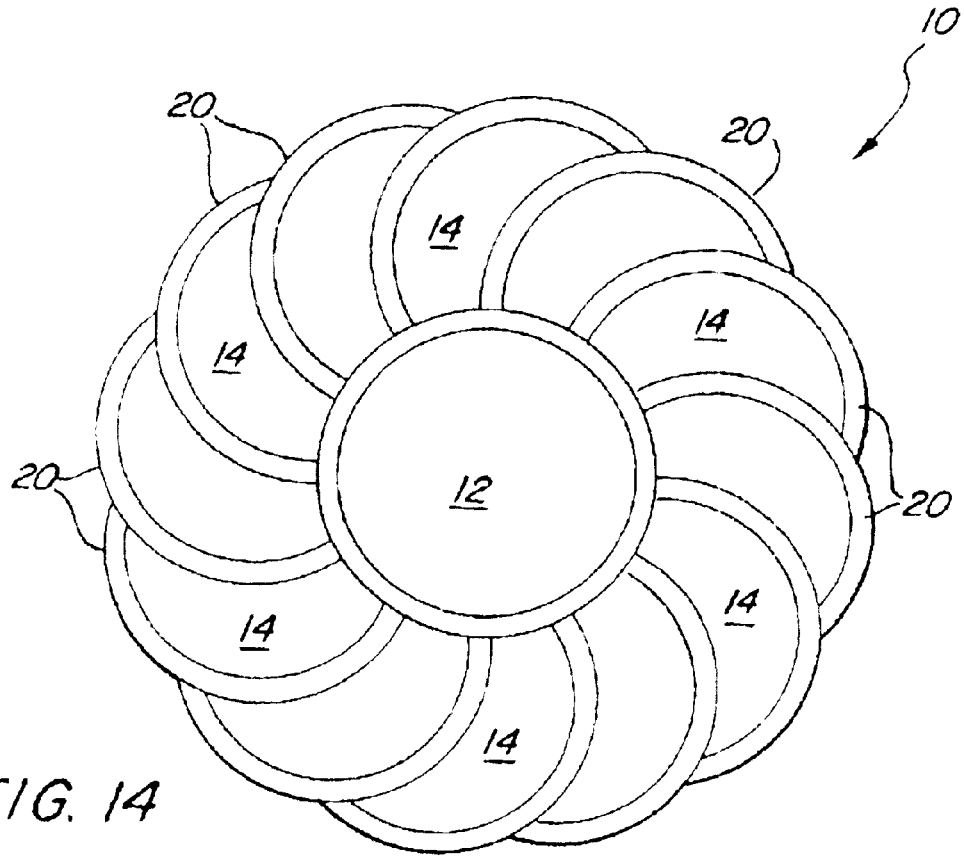

As illustrated in the top plan views of FIGS. 13, 14, 17 and 18, respectively, in other possible exemplary embodiments of the floating hull 10, the cells may be formed of a plurality of elongated wall segments 20, some of which may comprise recurvate elements, each having a first end joined to either a side wall of the central cell 12 (see FIGS. 13 and 14) or a first adjacent secondary cell 14 (see FIGS. 12, 17 and 18), and an opposite second end joined to a side wall of a second adjacent secondary cell. In the exemplary embodiment illustrated in FIG. 18, the side walls of the central cell 12 may be at least partially defined by a plurality of such recurvate wall segments.

Figure 15:
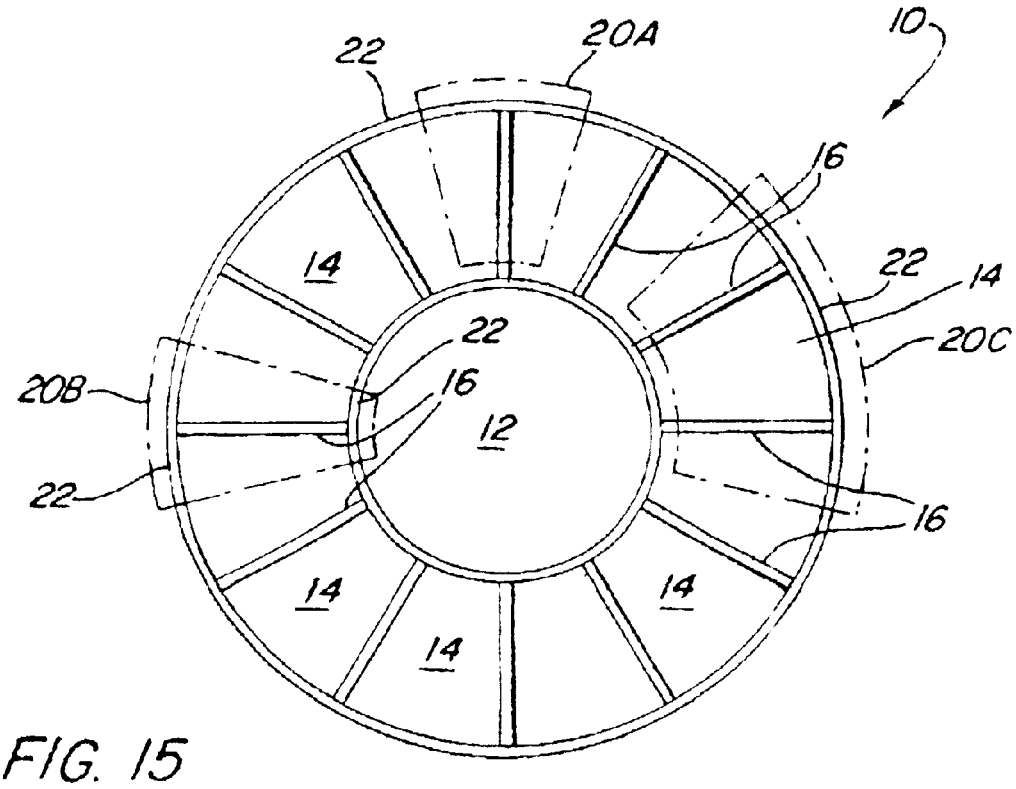

Alternatively, as illustrated in the top plan view of FIG. 15, the elongated wall segments of the cells may comprise webbed elements, each comprising at least one elongated web 16 and at least one elongated flange 22 disposed perpendicular to the web, in the fashion of an I-beam. These webbed elements may have cross sections that are, e.g., T-shaped, I-shaped or II-shaped, as shown by the phantom outlines 20A, 20B and 20C, respectively, in FIG. 15.

The side walls of the cells may comprise a variety of materials, including a metal, e.g., steel plate, reinforced concrete, or a composite material that includes a resin and a reinforcing fiber, e.g., fiberglass. For example, in only one of many possible embodiments thereof, the cells can comprise steel plates having a thickness of about 0.625-0.875 in. (15.875-22.225 mm) that are rolled into cylinders using a known type of rolling equipment, seam welded with automatic welding equipment in a manner similar to that used for seam-welded pipe, and placed horizontally on a powered roller that enables them to be precisely aligned end-to-end with each other, and then welded together, again using automated welding equipment.

Alternatively, the tubular cells can be formed by a spray application of concrete to a skeletal steel reinforcement mesh that has been preformed into the desired shape, in a manner similar to that in which concrete ships are fabricated. In yet another embodiment, a reinforcing mesh, e.g., fiberglass, can be laid over a form, and a liquid plastic resin can be applied to the mesh and then cured, in a manner similar to that in which fiberglass boats are constructed. In such an embodiment, the elongated webs 18 and wall segments 20 can be connected to each other with a chemical bonding process, e.g., an epoxy adhesive.

As those of skill in the art will appreciate from the foregoing, it is possible to confect a wide variety of floating hulls 10 having an outer peripheral surface essentially continuous over essentially the entire length thereof and containing a varying number of parallel tubular cells, each having a wide variety of possible cross-sectional shapes, and hence, internal oil and ballast storage capacities. For example, the exemplary hull illustrated in FIG. 17 includes a polygonal, viz., square, central cell 12 and a plurality of egg-shaped secondary cells 14.

To afford a substantially greater flexibility in and control over the liquid storage capability, buoyancy, trim, and stability of the platform 100 than those of prior art platforms, the tubular cells 12 and 14 of the floating hull 10 may be subdivided into compartments whose buoyancy and trim can be selectably adjusted by fixed or variable ballast, or a combination thereof, e.g., a solid ballast contained in or supported on the exterior of the cells, and a liquid ballast, e.g., petroleum or seawater, selectably pumped into or out of selected ones of the compartments. Further, some of the cells 12 and 14 may be positioned higher or lower in the water than the other cells, as described below.

Of importance, as used herein, "fixed ballast" refers to a liquid or solid ballast that substantially fills a compartment on a relatively permanent, or long-term basis, whereas, "variable ballast" refers to a liquid or a solid ballast that only partially fills a compartment, and on a relatively impermanent, or short-term basis. To ensure stability, the cells of the hull 10 preferably comprise three types of compartments, "buoyancy" compartments, "variable ballast" compartments, and "fixed ballast" compartments. These are preferably arranged within the hull as follows: The upper compartments of the cells are preferably used for buoyancy purposes, i.e., they are substantially filled with air. The intermediate compartments are preferably used for variable ballast purposes (i.e., filled with variable amounts of water and air). The lower compartments are preferably used for fixed ballast purposes (i.e., they are substantially filled with water or a solid ballast, e.g., steel pellets, or a combination thereof). If the hull 10 is also used for storing oil, the compartments devoted thereto are preferably arranged between the variable ballast compartments and the fixed ballast compartments, and can be used to store either one or both of sea water ballast or oil.

While the foregoing describes one possible preferred embodiment, depending on the particular operational, meteorological and oceanic conditions at hand, some the secondary cells 14 of the hull 10 may be used only for buoyancy purposes, while others can be used for mixed buoyancy and variable ballast functions (depending on the level of variable ballast required). Moreover, as discussed below, some of the cells may extend below the other cells when the hull is floating upright in water, and the compartments contained in the extended cells may be used only for fixed ballast, i.e., they may be completely and permanently filled with sea water, and further, may have fixed solid ballast in the form of "heave plates" supported thereon, or both.

An advantage of extending some of the cells 12 or 14 below the others in the hull 10 is that it reduces the weight and cost of the hull in those embodiments in which more cells not needed for storage or buoyancy. Further, the lowered section of the hull has a smaller cross-sectional area than that of hulls having their cells disposed at the same level, and consequently, loads on the hull due to currents and waves are minimized in this area, as sea water can flow more easily past the lowered section. This reduces the wave load on the hull and also helps to improve the stability of the platform 100. Thus, the combination of reduced weight, heave plates (with added mass) and reduced current and waves loads on the lower section all cooperate to enable the draft of the platform to be reduced, relative to platforms with hulls having cells disposed at the same level, but with the same or even greater stability.

Figure 16:
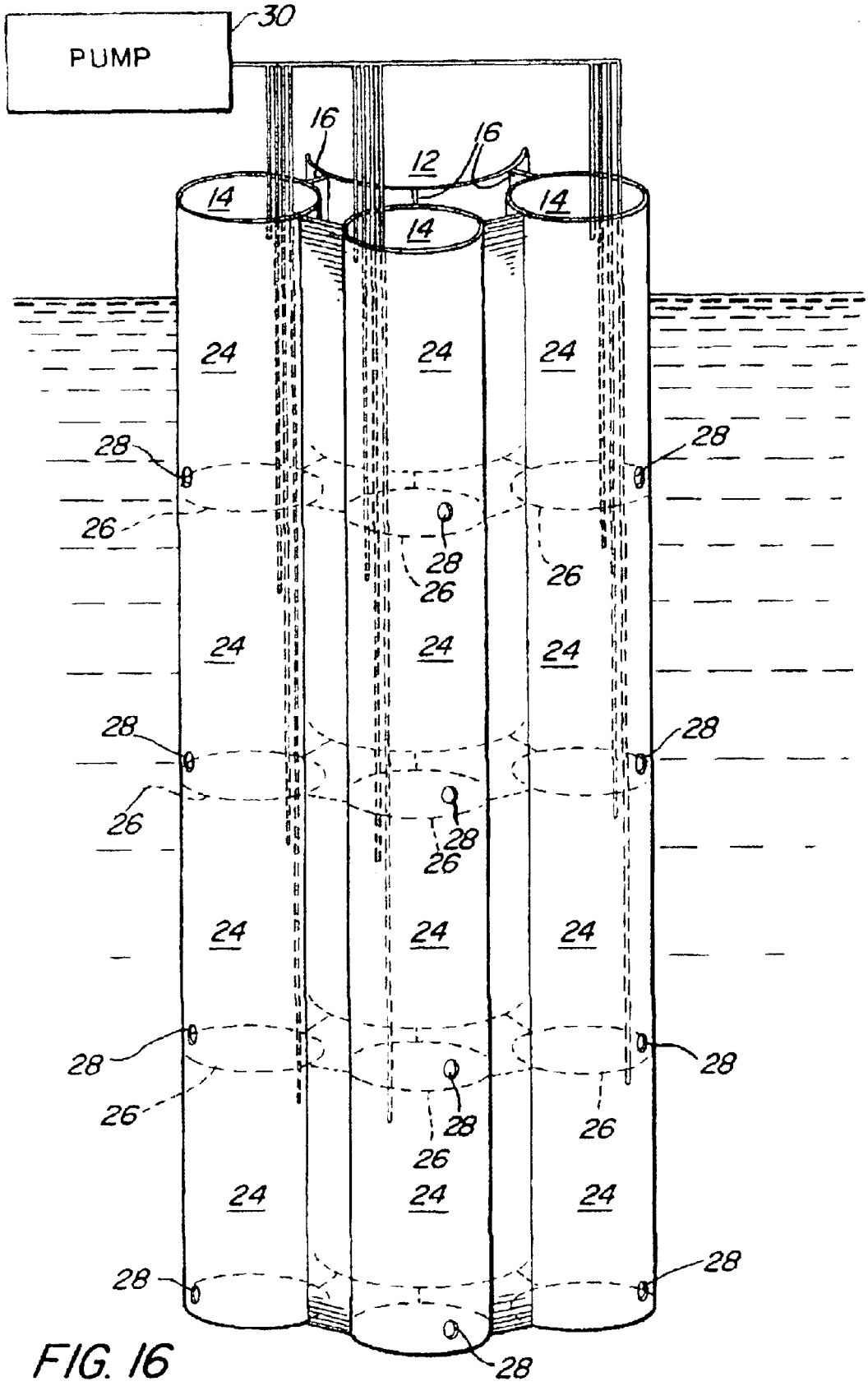
FIG. 16 is a top-and-side partial perspective view of three adjacent tubular cells of an exemplary hull in which the cells include a plurality of compartments defined by horizontal bulk-heads, side walls having openings for admitting seawater into and discharging it from the compartments, and an air pump connected to selected ones of the compartments to pump air into or out of them.
Figure 17:
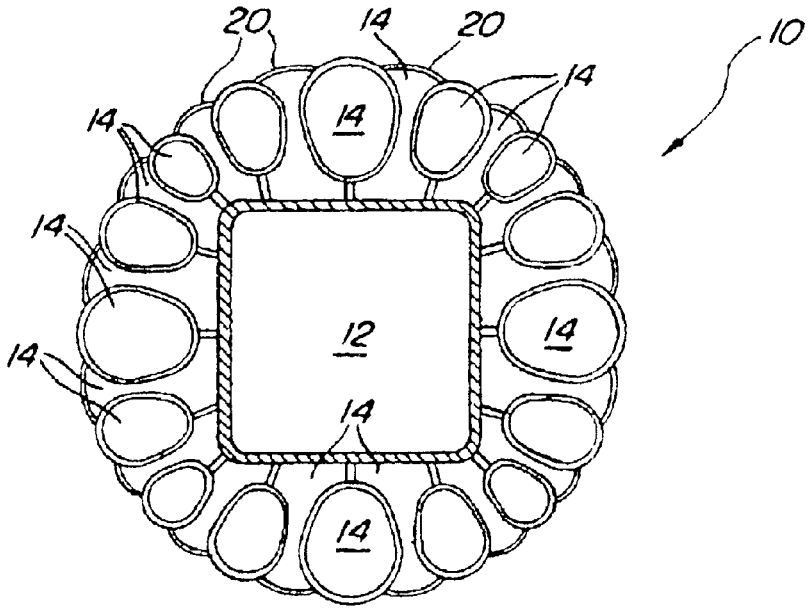
FIGS. 17 and 18 are respective top plan views of two other exemplary embodiments of floating hulls in accordance with the present invention.
Figure 18:
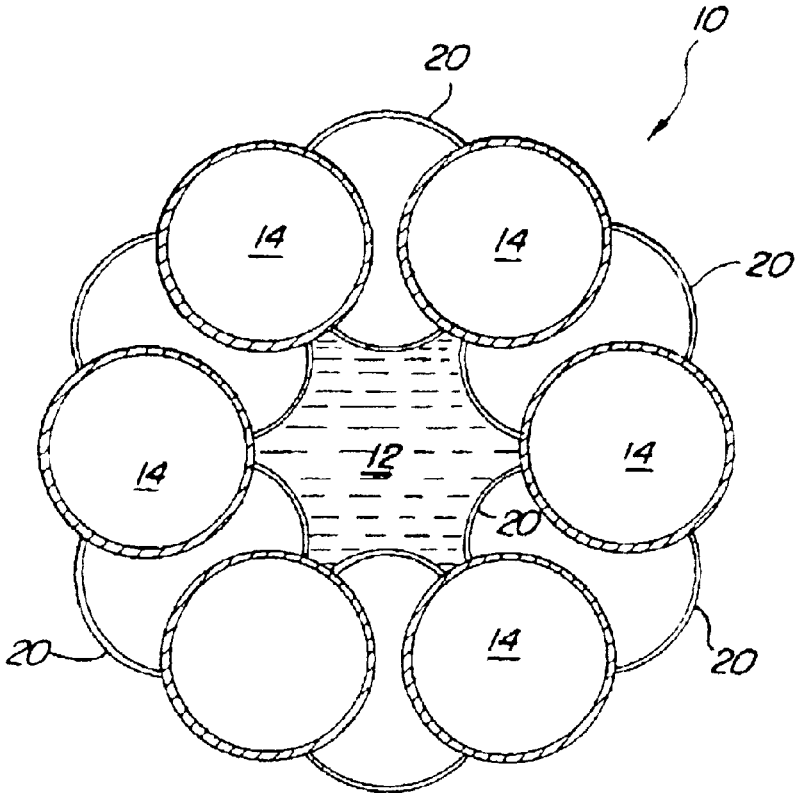

Thus, as illustrated in the top-and-side partial perspective view of three adjacent secondary cells 14 of an exemplary hull 10 shown in FIG. 16, each of the cells of the hull an be subdivided into a plurality of buoyant compartments 24 by, e.g., one or more transverse bulkheads 26 disposed in the cells. In another possible embodiment, only selected ones of the secondary cells 14 may incorporate internal bulkheads, while the "interstitial" secondary cells, which are not as well adapted to resist hydrostatic pressure acting thereon due to their complex shapes, may incorporate bulkheads only at one or both of the upper and lower ends thereof, and be pressurized internally such that the hydrostatic forces acting thereon are substantially cancelled out.

A side wall of one or more of the cells 12, 14 may incorporate one or more openings 28 for admitting seawater into, and discharging it from, the associated cell or the buoyant compartments contained therein in a selectable, controlled manner. This can be effected by, e.g., an air pump 30 connected to the buoyant compartments and operative to selectably pump air into or out of selected ones of the compartments. Alternatively, the sidewall openings of the cells can be omitted, the compartments vented to air and sea through pipes, and a water pump can be used to selectably pump sea water or petroleum ballast into or out of selected ones of the compartments. In either case, the variable ballast capability afforded by the arrangement can be used to correct trim and compensate for variations in the load of the platform flexibly and precisely.

As discussed above, in other exemplary embodiments of the hull 10, a lower portion of one or more of the cells may extend below the other cells when the hull is floating upright in water, and ballast, either fixed or variable, e.g., a solid ballast or sea water, or both, can be disposed on or in the inferiorly extending portion of the cell(s) to effect ballasting, as illustrated in FIGS. 19 and 20, respectively. In FIG. 19, the lower portion of the central cell 12 is disposed below the lower portions of the secondary cells 14, and three heave plates 32 (e.g., steel plates) are disposed on the exterior of the lower portion of the central cell. Fixed ballast, consisting of water permanently filling at least some of the compartments of this lower portion, may also be disposed in this lower portion to augment the weight of the heave plates. Additionally, when the platform is moving up and down, sea water will be entrapped between the heave plates, which provides the platform 100 with added mass in its lower portion. Preferably the lower heave plate comprises a tank having two compartments, an upper one filled with water and a lower one filled with a solid ballast (e.g., steel pellets).

In the embodiment illustrated in FIG. 20, three secondary cells 14 have lower portions extending below those of the other cells of the hull 10, and four fixed-ballast heave plates 32 are commonly supported on the exterior of the inferiorly extending portions thereof. As in the embodiment of FIG. 19, at least some of the compartments of the lower portion of the three extended secondary cells are permanently filled with water to provide additional fixed ballast to the hull. In both of the embodiments illustrated in FIGS. 19 and 20, the fixed ballast may alternatively or additionally be disposed within the lower portion of the cell(s) or a compartment contained therein, and in either case, serves, among other things, to lower the center of gravity of the platform 100 substantially below its center of buoyancy, thereby enhancing the stability of the platform by increasing its natural period above that of the waves in, e.g., a storm condition, as discussed above.

In comparison to the embodiment of FIG. 1, the embodiments of FIGS. 19 and 20 enable a reduction in the cost of the platform 100 to be achieved, as less steel is required to build the respective hulls 10, and further, they enable an enhancement in the stability of the platform to be achieved, as loads applied to the respective lower portions of the hulls due to waves and currents are reduced. This results from the fact the surface area of the respective lower portions of the hulls of FIGS. 19 and 20 are each smaller than that of the hull of FIG. 1, and consequently, loads applied by wave and currents on this surface are correspondingly reduced.

Figure 22B:
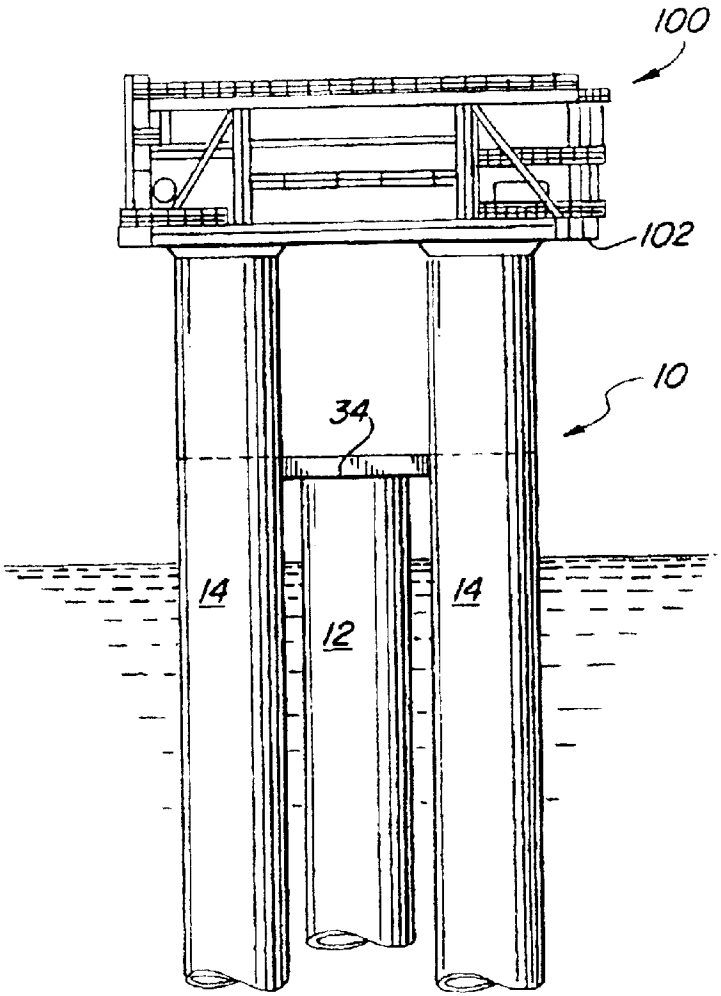
FIGS. 22*a* and 22*b* are partial elevation views of a spar-type platform floating in water and incorporating a floating hull in accordance with the present invention in which the upper end of the central cell is disposed below the upper ends of the other cells such that it lies respectively below and above the surface of the water; and, FIG. 23 is a partial elevation view of a floating hull in accordance with the present invention showing helical strakes disposed on an outer peripheral surface of the cells.
Figure 22A:
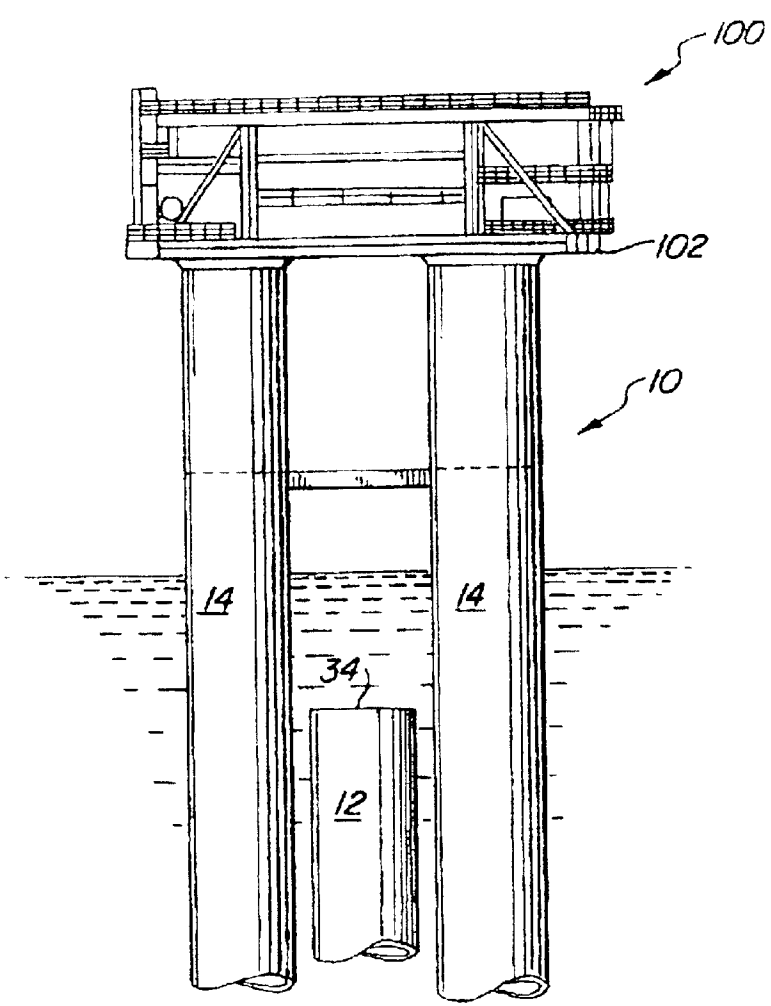

In another exemplary embodiment of a floating hull 10 in accordance with the present invention, an upper end 34 of at least one of the cells, e.g., the central cell 12, can be disposed below an upper end of the other cells when the hull is floating upright in water, and further, can be positioned to lie either below or above the surface of the water, as illustrated in FIGS. 22*a* and 22*b*, respectively. When the upper ends of these cells are positioned below the surface of the water, the hull's water plane area is decreased, thereby increasing its natural period, whereas, when they are positioned above the surface of the water but below the deck 102, they minimize the loads acting on the hull by waves. This arrangement enables a greater flexibility in and control over the trim and stability of the platform.

Figure 21:
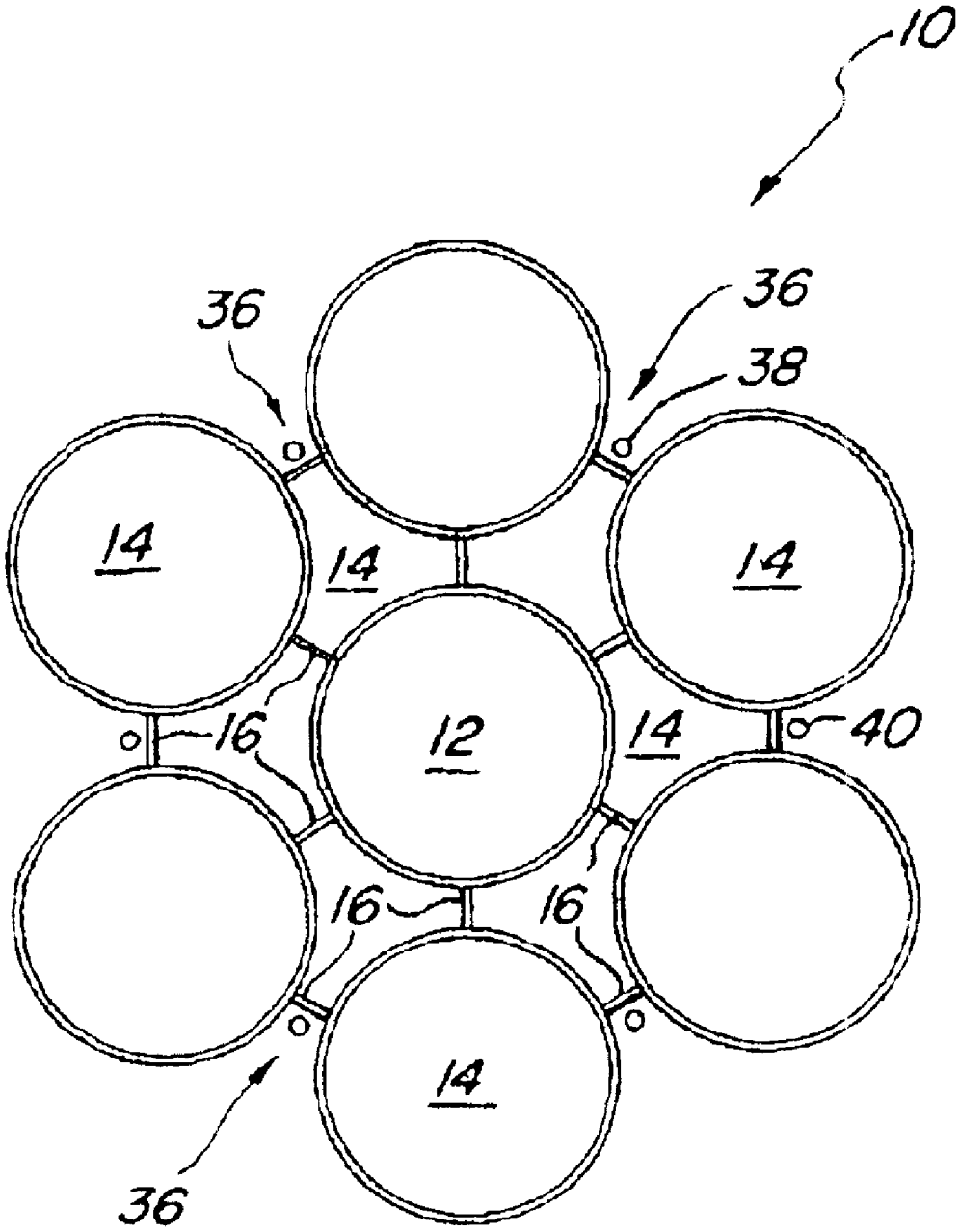
FIG. 21 is a cross-sectional view through the exemplary floating hull of FIGS. 1 and 2, showing mooring lines and piping routed through longitudinal recesses formed in an exterior peripheral surface of the platform by the juncture of two adjacent cells.

FIG. 21 is a cross-sectional view of the exemplary floating hull 10 illustrated in FIGS. 1 and 2 and illustrates another feature of the floating hull 10 of the present invention, viz., one or more longitudinal recesses 36 may be formed in an exterior peripheral surface of the platform 100, e.g., at the juncture of two secondary cells 14, and mooring lines 38 and piping 40 may be routed in these recesses to reduce drag on the platform and undesirable, vortex-induced vibrations thereof.

Figure 23:
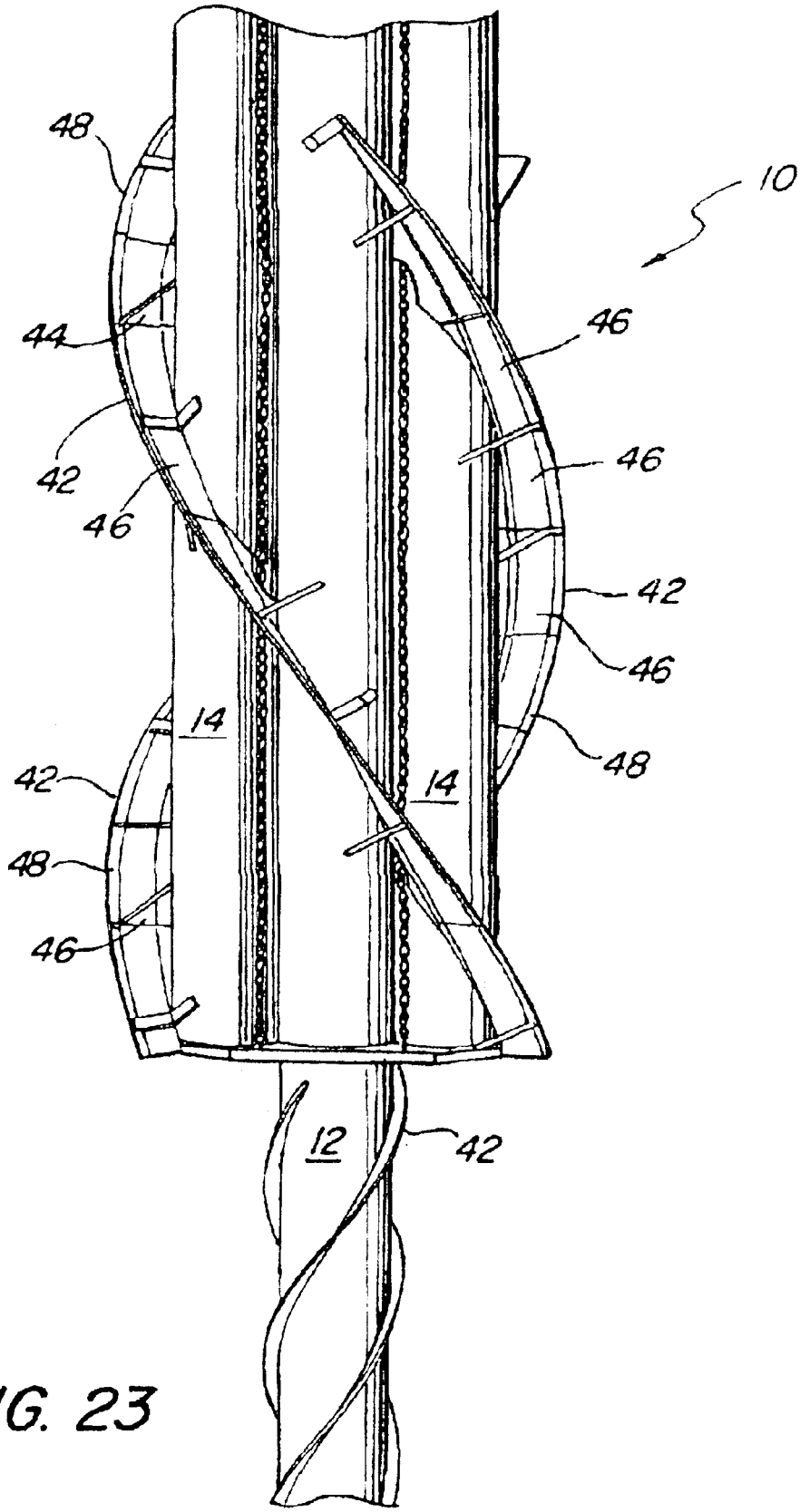

Another feature of the present invention is illustrated generally in the exemplary hulls 10 of FIGS. 19 and 20, and in more detail in the partial elevation view of the hull of FIG. 23. In these figures, an outer peripheral surface of some or all of the cells 12 and 14 of the hull are provided with stepped, helical strakes 42 supported by a plurality of radially extending gusset plates, or stanchions 44. The strakes comprise a continuous, spiral ribbon that circumscribes the cell or hull, and serves to reduce vortex-induced vibrations resulting from ocean currents acting on the platform 100. These vibrations can occur, e.g., when the natural period of vibration of the hull 10 coincides with that of the vortex-shedding period.

In the particular embodiment illustrated in FIG. 23, the strakes 42 comprise flat panels 46 that are reinforced at their outer edges by a longitudinal structural member 48. The panels are connected together at their adjacent ends and supported thereat by the stanchions 44, which are affixed to the exterior surface of the cells 12 and 14 of the hull 10. The lowermost end of the longitudinal member provides a foundation for attaching the panels to the hull along the spiral path. The plates thus conform closely to the curvature of the hull, thereby blocking the flow of water at the base of the strakes. In one possible embodiment, the outer edges of the panels may extend beyond the longitudinal reinforcing member, thereby providing a relatively sharp edge on the strake, which enhances the performances of the strake by breaking up eddies as seawater passes over the top of the strake. The advantages of the foregoing stepped, helical design are that it is lighter and less costly to make than current strake designs, and is easier to install, in that the panels are flat plates, thereby eliminating the need to form or roll the panels.

In another aspect of the invention, methods are provided for efficiently constructing the floating hull of the invention. In one exemplary embodiment thereof illustrated in FIG. 4, the method comprises providing a tubular central cell 12, blocking off the opposite ends thereof, e.g., with bulkheads, such that it is rendered buoyant, and supporting it horizontally on an elevator 50 of a graving dock 52 such that the weight of the cell is borne partially by the elevator and partially by the water in the dock. A secondary tubular cell 14 is then disposed parallel to the central cell and connected to it with an elongated web 16, e.g., by a welding or a chemical bonding process, as described above. Additionally, as described above, the central cell may be connected to the secondary cell with a second elongated web such that a third tubular cell is formed parallel and adjacent to the central and secondary cells.

As illustrated in the successive views of FIGS. 5–11, in another exemplary embodiment of the method, the top and bottom ends of the central cell 12 can be closed off, thereby rendering it buoyant, as above, and the cell can then be floated horizontally in a body of water, such as at a graving dock 52 or shipyard that does not have an elevator, such that the weight of the cell is at least partially borne by the water and partially borne by, e.g., one or more lifting cranes 54. This embodiment of the method enables the central cell to be rotated easily in the water about its long axis, e.g., with the cranes, as one or more secondary cells 14 are successively connected to it, then lowered into the water such that their added buoyancy helps to support the assembly, as illustrated in the figures.

By now, those of skill in this art will appreciate that many modifications and variations are possible in terms of the configurations, materials and methods of the present invention without departing from its spirit and scope. Accordingly, the scope of the present invention should not be limited by that of the particular embodiments described and illustrated herein, as these are merely exemplary in nature. Rather, the scope of the present invention should be commensurate with that of the claims appended hereafter and their functional equivalents.

What is claimed is:

1. A floating hull for supporting a deck used in deepwater oil and gas drilling and production operations, the hull comprising:

a tubular central cell;

a plurality of tubular secondary cells arranged around and parallel to the tubular central cell;

a plurality of first elongated webs radially connecting the secondary cells to the central cell; and, a plurality of second elongated webs circumferentially connecting the secondary cells together, wherein the elongated webs, the central cell and the secondary cells form a plurality of tubular interstitial cells parallel and adjacent to the central and secondary cells;

wherein at least one of the cells comprises at least one intermediate transverse bulkhead forming at least one compartment in the at least one cell: and wherein the cells provide buoyancy to the platform that can be controlled by a ballast.

2. The floating hull of claim 1, wherein the central cell defines a center well.

3. The floating hull of claim 1, wherein the ballast comprises at least one of variable ballast and fixed ballast.

4. The floating hull of claim 3, wherein the ballast is disposed in a lower portion of at least one of the cells when the hull is floating upright in water.

5. The floating hull of claim 4, wherein the lower portion of the at least one cell extends below a lower portion of the other cells.

6. The floating hull of claim 4, wherein the at least one cell comprises the central cell.

7. The floating hull of claim 4, wherein the at least one cell comprises the secondary cell.

8. The floating hull of claim 1, wherein an upper end of at least one of the cells is disposed below an upper end of the other cells when the hull is floating upright in water.

9. The floating hull of claim 8, wherein the upper end of the at least one cell is disposed above or below the surface of the water.

10. The floating hull of claim 1, wherein at least one longitudinal recess is formed in an exterior peripheral surface of the platform, and wherein at least one of mooring lines and piping is disposed in the recess.

11. The floating hull of claim 1, wherein at least one of the cells has a circular cross section.

12. The floating hull of claim 1, wherein at least one of the cells has an egg-shaped cross section.

13. The floating hull of claim 1, wherein a side wall of at least one of the cells includes an opening for admitting and discharging water into and from the cell.

14. The floating hull of claim 1, further comprising a pump connected to the at least one compartment and operative to pump air or water into or out of the compartment.

15. The floating hull of claim 1, further comprising helical strakes disposed on an outer peripheral surface thereof.

16. A method of constructing the floating hull of claim 1, the method comprising:

providing a tubular central cell;

providing a plurality of tubular secondary cells disposed parallel to the central cell;

radially connecting the secondary cells to the central cell with a first plurality of elongated webs; and, circumferentially connecting the secondary cells together with a second plurality of elongated webs such that the elongated webs, the central cell, and the secondary cells form a plurality of tubular interstitial cells parallel and adjacent to the central and secondary cells.

17. The method of claim 16, further comprising:

radially connecting the secondary cells to the central cell with at least two elongated webs such that a plurality of tubular interstitial cells are formed parallel and adjacent to the central and secondary cells.

18. The method of claim 16, wherein providing the central cell comprises:

closing top and bottom ends of the central cell; and, floating the central cell in water such that a long axis of the cell is disposed horizontally and the weight of the cell is at least partially supported by the water.

19. The method of claim 16, further comprising:

rotating the central cell in the water about its long axis before connecting the secondary cells to the central cell.

20. The method of claim 16, wherein connecting the secondary cells to the central cell comprises welding.

21. The method of claim 16, wherein connecting the secondary cells to the central cell comprises chemical bonding.

22. A floating hull for supporting a deck used in deepwater oil and gas drilling and production operations, the hull comprising:

a tubular central cell; and, a plurality of elongated webs having a first end connected to a side wall of the central cell and second end connected to an adjacent elongated web, wherein the elongated webs and the central cell form a plurality of secondary cells parallel and adjacent to the central cell, and wherein the cells provide buoyancy to the platform that can be controlled by a ballast.

23. The floating hull of claim 22, wherein the central cell defines a center well.

24. The floating hull of claim 22, wherein an outer peripheral surface of the floating hull is substantially continuous over substantially the entire length thereof.

25. The floating hull of claim 22, wherein said ballast is disposed in a lower portion of at least one of the cells when the hull is floating upright in water.

26. The floating hull of claim 25, wherein the at least one cell comprises the central cell.

27. The floating hull of claim 25, wherein the at least one cell comprises at least two secondary cells.

28. The floating hull of claim 22, wherein the elongated webs comprise a metal, concrete, or a composite material that includes a plastic resin and a reinforcing fiber.

29. The floating hull of claim 22, wherein the elongated webs have cross sections that are selected from the group consisting of T-shaped, I-shaped and II-shaped.

30. A floating hull for supporting a deck used in deepwater oil and gas drilling and production operations, the hull comprising:

a tubular central cell;

a plurality of tubular secondary cells arranged around and parallel to the tubular central cell;

a plurality of first elongated webs radially connecting the secondary cells to the central cell; and, a plurality of second elongated webs circumferentially connecting the secondary cells together, and wherein:

the elongated webs, the central cell and the secondary cells form a plurality of tubular interstitial cells parallel and adjacent to the central and secondary cells;

the cells provide buoyancy to the platform that can be controlled by a ballast;

at least one longitudinal recess is formed in an exterior peripheral surface of the platform; and, at least one of mooring lines and piping is disposed in the recess.

* * * * *

UNITED STATES PATENT AND TRADEMARK OFFICE

CERTIFICATE OF CORRECTION

PATENT NO. : 6,817,309 B2
DATED : November 16, 2004
INVENTOR(S) : Edward E. Horton It is certified that error appears in the above-identified patent and that said Letters Patent is hereby corrected as shown below:

Column 3,
Line 18, from "I I-shaped" to -- π-shaped --.

Column 6,
Line 12, from "elongated wall segments of the cells" to -- elongated wall segments 20 of the cells --.
Line 18, from "I I-shaped" to -- π-shaped --.

Column 10,
Line 40, from "one cell: and" to -- one cell; and --.

Column 11,
Line 36, from "claim 16" to -- claim 18 --.

Column 12,
Line 4, from "wherein the elongated webs and the central cell form a plurality of seondary cells parallel and adjacent to the central cell, and" to -- wherein the elongated webs and the central cell form a plurality of secondary cells parallel and adjacent to the central cell, and wherein at least some of the elongated webs comprises at least one elongated web and at least one elongated flange disposed generally perpendicular to the web; and --
Line 26, from "I I-shaped" to -- π-shaped --.

Signed and Sealed this

Fifth Day of April, 2005

JON W. DUDAS
*Director of the United States Patent and Trademark Office*